US005123748A

United States Patent [19]

Schröer

[11] Patent Number: 5,123,748

[45] Date of Patent: Jun. 23, 1992

[54] MIXING DEVICE WITH CENTRAL THERMAL ELEMENT

[75] Inventor: Johannes D. Schröer, Deventer, Netherlands

[73] Assignee: N.V. Machinefabriek Terlet, Zutphen, Netherlands

[21] Appl. No.: 543,884

[22] Filed: Jun. 27, 1990

[30] Foreign Application Priority Data

Jul. 7, 1989 [NL] Netherlands ..... 8901749

[51] Int. Cl.[5] ..... B01F 7/08; B01F 15/06

[52] U.S. Cl. ..... 366/287; 165/109.1; 366/143; 366/147; 366/319; 366/323; 366/331

[58] Field of Search ..... 366/64, 65, 81, 88, 366/96-98, 100, 144, 147, 241, 279, 287, 281-284, 288, 318, 319, 323, 331, 143; 165/88, 109.1

[56] References Cited

U.S. PATENT DOCUMENTS

| | | | |
|---|---|---|---|
| 1,268,813 | 6/1918 | Benjamins | 366/88 X |
| 1,962,803 | 6/1934 | Bruins | 366/147 X |
| 2,521,406 | 9/1950 | Pinto | 165/109.1 X |
| 2,668,764 | 2/1954 | Nauta | 366/319 X |
| 2,831,663 | 4/1958 | Nauta | 366/287 |
| 2,864,593 | 12/1958 | Shoup | 366/319 X |
| 3,241,606 | 3/1966 | Honjo et al. . | |
| 3,338,562 | 8/1967 | Fox | 366/287 |
| 3,556,487 | 1/1971 | Nauta | 366/98 X |
| 3,567,402 | 3/1971 | Christensen . | |
| 3,775,863 | 12/1973 | Updegrove | 366/287 X |
| 3,820,597 | 6/1974 | Bittner et al. | 165/109.1 |
| 3,937,444 | 2/1976 | Kapp | 366/331 X |
| 4,145,144 | 3/1979 | Nauta | 366/287 |
| 4,437,766 | 3/1984 | Joachim | 366/287 |
| 4,534,658 | 8/1985 | De Vries | 366/287 |

FOREIGN PATENT DOCUMENTS

| | | | |
|---|---|---|---|
| 0038521 | 10/1981 | European Pat. Off. . | |
| 0042588 | 12/1981 | European Pat. Off. . | |
| 0128609 | 12/1984 | European Pat. Off. . | |
| 1116195 | 11/1961 | Fed. Rep. of Germany | 366/318 |
| 3309041 | 9/1984 | Fed. Rep. of Germany . | |
| 3508711 | 9/1986 | Fed. Rep. of Germany | 366/287 |
| 1135654 | 11/1955 | France | 366/287 |
| 441756 | 8/1964 | Japan | 366/287 |
| 235527 | 2/1964 | Netherlands | 366/318 |
| 281191 | 12/1964 | Netherlands | 366/318 |
| 7005884 | 10/1971 | Netherlands | 366/318 |
| 929023 | 6/1963 | United Kingdom . | |
| 1050216 | 12/1966 | United Kingdom . | |
| 2158365 | 11/1985 | United Kingdom . | |

*Primary Examiner*—Philip R. Coe
*Assistant Examiner*—C. Cooley
*Attorney, Agent, or Firm*—Fleit, Jacobson, Cohn, Price, Holman & Stern

[57] ABSTRACT

Mixing device for powdered, granular and/or paste materials, having a conical mixing tank (1) with vertical axis which narrows towards the bottom, and in said mixing tank at least one mixing screw (2), which through drive units disposed outside the mixing tank (1), by means of a transmission arm (15) to be rotated in a horizontal plane, can rotate about its own axis and can revolve along the wall of the mixing tank, the shaft of the mixing screw (2) at the top end being provided with a gear wheel (3) which meshes with a gear wheel (4) with vertical shaft, which has a smaller diameter than the gear wheel (3) on the mixing screw (2) whereby the gear wheel (4) with vertical shaft is connected by means of a belt connection (7) or the like in the arm (15) to a central vertical shaft (9) which by means of a reducing transmission (10, 11, 12) is coupled to the drive unit (13) for rotation of the mixing screw (2).

7 Claims, 1 Drawing Sheet

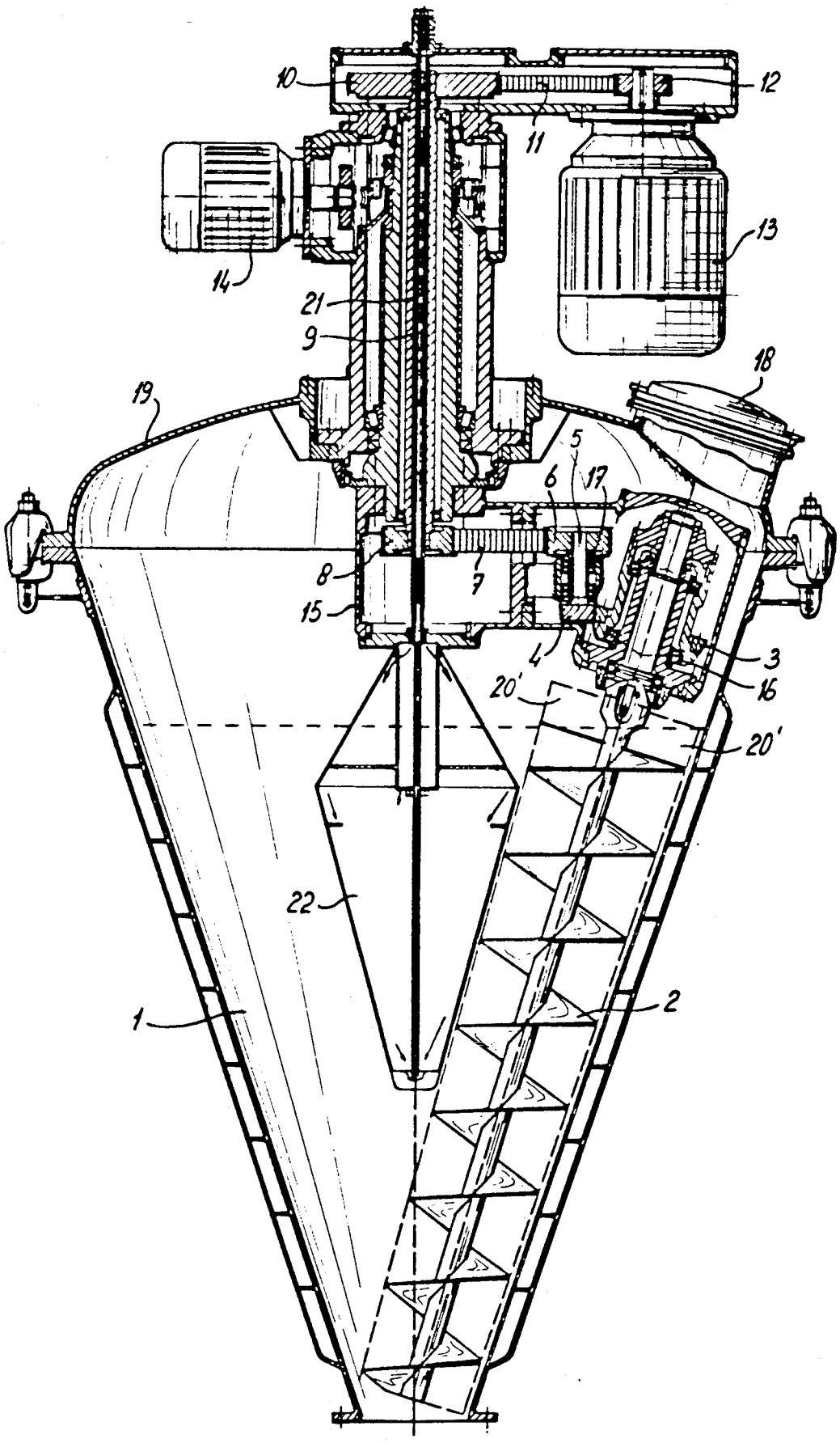
10
12
11
13
14
21
9
18
19
5
6
17
8
7
15
4
3
16
20'
20'
22
1
2

MIXING DEVICE WITH CENTRAL THERMAL ELEMENT

The invention relates to a mixing device for powdered, granular and/or paste materials, having a mixing tank with vertical axis and in said mixing tank at least one mixing screw, of which the axis runs essentially parallel to the describing line of the wall of the mixing tank, and which mixing screw through drive units disposed outside the mixing tank, by means of a transmission arm to be rotated in a horizontal plane, can rotate about its own axis and can revolve along the wall of the mixing tank, the shaft of the mixing screw at the top end being provided with a gear wheel which meshes with a gear wheel with vertical shaft.

Such a mixing device is known from British Patent Specification 673,617, in which the bevel gear wheel on the shaft of the mixing screw meshes with a bevel gear wheel of greater diameter. The rotary shaft of this larger gear wheel has a further gear wheel which in turn meshes with a gear wheel of greater diameter which is driven by the drive motor.

All these gear wheels with their shafts are accommodated in an oil-filled rotating arm. In addition, all gearings are accelerating gearings, as a result of which the speed of rotation at which the mixing screw rotates about its own axis is fairly high, so that this mixing device is not suitable for high power.

The oil-filled arm also makes it unsuitable for mixing some materials, such as foods and pharmaceutical materials, in which no oil leakage at all is permissible.

The object of the invention is to make the mixing device suitable for a high power, and also to make it work dry, i.e. without oil.

This is achieved according to the invention in that the gear wheel with vertical shaft has a smaller diameter than the gear wheel on the mixing screw, and in that the gear wheel with vertical shaft is connected by means of a belt connection or the like in the arm to a central vertical shaft which by means of a reducing transmission is coupled to the drive unit for rotation of the mixing screw.

A great reduction in speed, and thus high power, is possible through the reducing transmissions.

In addition, the belt transmission or the like requires no lubrication, while the single geared transmission can be made so that it is lubricated for life.

The drive shaft running in the axis of the generally conical mixing tank can now, through the "dry" horizontally running transmission arm, be designed as a hollow shaft, which is known per se in the case of "wet" transmissions, but not in the case of "dry" transmissions.

In the case of a mixing device in which the central vertical shaft is made hollow and is provided internally with a concentric tubular structure, according to a further feature of the invention an element situated in the centre of the mixing tank is fixed below the horizontal arm on the concentric tubular structure, which element can be supplied with a heating or cooling medium which can be discharged again through the tubular structure, as a result of which an additional heating or cooling surface is obtained in the centre of the mixing tank.

The element is preferably the shape of a double cone.

The mixing screw or each mixing screw is preferably a slightly tapering shape, the angle of taper being 2°-3°, and the mixing screw having a smaller diameter in the bottom of the mixing tank than in the top.

In this way the mixing screw is loaded more evenly because less material has to be dug away at the bottom of the mixing tank than at the top. This thus improves the efficiency for the mixing device.

The mixing screw or each mixing screw is preferably also provided at the top end with radially running vanes. These serve to level off uneven mounds in the material to be mixed. This means that the mixing tank can be made less high.

The top wall of the mixing tank preferably also has a manhole which can be shut off, and the arm with belt transmissions and geared transmission is designed in such a way that repair, maintenance and the like are easy to carry out.

Due to the fact that no oil is present in the arm, the maintenance and the like are very easily possible through the manhole, which means that the mixing device need never be out of service for long.

The hollow shaft construction, which is known in the case of "wet" transmissions, but not in the case of "dry" transmissions, is suitable for many other potential applications which hitherto were not possible in the case of "dry" transmissions, but which were known in the case of "wet" transmissions, such as the sprinkling of materials to be mixed.

The invention will be explained in further detail with reference to the sectional drawing for an example of an embodiment.

A mixing screw 2 rotates and revolves in a generally conical mixing tank 1.

The top end of the mixing screw 2 is provided with a bevel gear wheel 3, which meshes with a much smaller gear wheel 4 with vertical rotary shaft 5. Situated on this rotary shaft 5 is a pulley 6 or the like which is coupled by means of a belt 7 to a pulley 8.

This pulley 8 is fitted on a hollow shaft 9, on the top end of which is a pulley 10 which is coupled by means of a belt 11 to a pulley 12, which is driven by the motor 13.

The transmission 10, 11, 12 and 4, 3 are highly reducing, so that the mixing screw 2 rotates about its own axis at low speed and thereby can supply a high power.

The motor for revolving of the mixing screw 2 is indicated by 14. This drive is further known per se and will not be described in any greater detail.

The pulleys 6 and 8, the belt 7 and the gear wheels 3 and 4 are accommodated in the horizontally revolving arm 15.

Unlike the state of the art, in which the arm comprises an oil-filled box, the arm 15 according to the invention is a dry space, inside which the belt transmission 6, 7, 8 is disposed, and also the geared transmissions 3, 4 which are equipped with bearings 16, 17 respectively which are lubricated for life.

This "dry" arm 15 makes it possible for the maintenance, repair and the like to be carried out through a manhole 18 which is disposed on the cover 19 of the mixing tank.

The describing line of the periphery of the mixing screw 2 preferably runs at an angle of 2°-3° relative to the axis, converging in the downward direction. This makes the mixing screw 2 slightly narrower in the bottom of the mixing tank than in the top.

This measure ensures that the mixing screw 2 is more uniformly loaded. Less material is dug away in the bottom of the mixing tank 1, and more material in the top.

This also contributes towards achieving a greater power.

On the top winding of the mixing screw three or four radially running vanes 20, 20' are fixed at angles of 120° and 90° respectively. The vanes 20, 20' are shown at 180° only for illustrative purposes.

These vanes 20 rotating along with the mixing screw 2 are used to scrape away mounds in the material in the mixing tank 1. This also contributes to a high power being achieved.

The shaft on which the pulleys 8 and 10 are fixed is hollow, which makes it possible to pass a tubular structure 21, comprising two concentric tubes, through the hollow tube 9.

By means of this tubular structure 21, it is, for example, possible to spray gas and/or liquid into the mixing tank. This is known per se.

On the bottom end of the tubular structure 21 it is, however, also possible to fit a hollow element 22 in the form of a double cone, the shape of the bottom cone being adapted to the inner path of the conical space to be described by the mixing screw 2.

The outermost tube of the tubular structure 21 ends at the top end of the element 22. Through the annular space between the inner and outer tube of the tubular structure 21 it is possible to inject, for example, steam or a cooling medium.

This medium moves downwards along the inner surface of the element 22, as indicated by arrows.

In the bottom of the element 22 the inner tube is open, so that the medium can be discharged through the central tube.

This forms an additional heating or cooling surface in the mixing tank 1. This can be desirable for some materials.

The element 22 can be stationary, but can also be rotated by means of the hollow tubular structure 21 in both directions and at different speeds.

I claim:

1. Mixing device for powdered, granular and/or paste materials, comprising:

a conical mixing tank having a vertical axis, which narrows towards the bottom, a central vertical shaft projecting into said conical mixing tank;

at least one mixing screw in said mixing tank, having an axial shaft essentially parallel to a describing line of the wall of the mixing tank;

a drive unit for said at least one mixing screw disposed outside the mixing tank whereby through means of a transmission arm to be rotated in a horizontal plane, said at least one mixing screw can rotate about its own axis and can revolve along the wall of the mixing tank, a top end of the shaft of the mixing screw being provided with a gear wheel which meshes with a gear wheel having a vertical shaft, the gear wheel with the vertical shaft having a smaller diameter than the gear wheel on the mixing screw, and a reducing transmission coupled to a drive unit for rotation of said at least one mixing screw about its own axis comprising belt means in the arm for transmitting rotary motion to the gear wheel with the vertical shaft from said central vertical shaft;

wherein the central vertical shaft is hollow and the mixing device further comprises a concentric tubular structure within the central vertical shaft and an element situated in a central portion of the mixing tank and fixed below the arm on the concentric tubular structure, which element can be supplied with a heating or cooling medium which can be discharged through the tubular structure, whereby an additional heating or cooling surface is obtained in the center of the mixing tank.

2. Mixing device according to claim 1, in which the element is the shape of a double cone.

3. Mixing device according to claim 1 in which the heating or cooling medium is fed from the top side of the element along the internal surface of the element and in the bottom of the element is discharged through an interior tube of the concentric tubular structure.

4. Mixing device according to claim 1, further comprising means for rotating the element.

5. Mixing device according to claim 1, in which each mixing screw has a slightly tapering shape with an angle of taper of 2°-3°, the mixing screw having a smaller diameter at the bottom of the mixing tank than at the top.

6. Mixing device according to claim 1, in which the top end of each mixing screw is provided with vanes extending radially therefrom.

7. Mixing device according to claim 1 in which the top wall of the mixing tank has a manhole for access, and the mixing device further comprises means for convenient maintenance and repair of the horizontal arm, belt means and said gears by access through the manhole.

* * * * *